United States Patent [19]

Tamura et al.

[11] 4,447,384

[45] May 8, 1984

[54] PROCESS FOR PRODUCING ANTIPILLING ACRYLIC SYNTHETIC FIBER

[75] Inventors: Hitoshi Tamura, Hiroshima; Katsuhei Shigeoka, Yamaguchi, both of Japan

[73] Assignee: Mitsubishi Rayon Co., Ltd., Tokyo, Japan

[21] Appl. No.: 339,008

[22] Filed: Jan. 12, 1982

[30] Foreign Application Priority Data

Jan. 19, 1981 [JP] Japan ..... 56-6067

[51] Int. Cl.[3] ..... D01F 6/18

[52] U.S. Cl. ..... 264/206; 264/210.7; 264/210.8

[58] Field of Search ..... 264/206, 210.7, 182, 264/210.8

[56] References Cited

U.S. PATENT DOCUMENTS

| | | | |
|---|---|---|---|
| 3,097,415 | 7/1963 | Davis | 264/206 |
| 3,404,204 | 10/1968 | Nakagawa et al. | 264/182 |
| 3,560,603 | 2/1971 | Ryan | 264/168 |
| 3,878,178 | 4/1975 | Guinn et al. | 264/182 |
| 3,976,737 | 8/1976 | Sekiguchi et al. | 264/182 |
| 4,205,037 | 5/1980 | Fujimatsu | 264/182 |
| 4,383,086 | 5/1983 | Fester et al. | 264/206 |

FOREIGN PATENT DOCUMENTS

| | | | |
|---|---|---|---|
| 19870 | 10/1980 | European Pat. Off. | 264/206 |
| 41-7898 | 1/1966 | Japan | 264/206 |
| 46-36490 | 10/1971 | Japan | 264/182 |
| 51-75151 | 6/1976 | Japan | 264/206 |
| 51-102120 | 9/1976 | Japan | 264/206 |
| 53-111126 | 9/1978 | Japan | 264/206 |
| 55-76108 | 6/1980 | Japan | 264/210.8 |

*Primary Examiner*—Jay H. Woo

*Attorney, Agent, or Firm*—Armstrong, Nikaido, Marmelstein & Kubovcik

[57] ABSTRACT

An acrylic fiber produced by the dry-spinning process having, as characteristic properties, a tensile strength of 1.2–2.5 g/denier, a knot strength (g/denier)-knot elongation (%) product of 25 or less and a boiling water shrinkage rate of 5% or less. Said fiber can be obtained by dry-spinning a spinning solution of acrylonitrile type polymer containing 85% by weight or more of acrylonitrile, stretching the resulting fiber in hot water at a stretch ratio ranging from 1 to 2, subjecting the stretched fiber to a drying and relaxing to give the fiber a shrinkage of 10–40% and then stretching it at a stretch ratio of 1.2–2.3 at a temperature of 180°–210° C.

4 Claims, No Drawings

PROCESS FOR PRODUCING ANTIPILLING ACRYLIC SYNTHETIC FIBER

This invention relates to an acrylic synethetic fiber excellent in antipilling property, as well as to a process for producing said fiber.

More particularly, this invention relates to an acrylic synthetic fiber excellent in antipilling property which is obtainable by the dry-spinning process, has specified fiber performances and is good in processability, as well as to a process for producing said fiber with an industrial advantage in which the conditions of stretching, drying and relaxing treatment and specified in the stage of producing the fiber.

As is well known, the pill formed on worn clothing markedly detracts from the appearance and feel of the clothing. The occurrence of pill is particularly remarkable in acrylic fibers because they are used mainly in the field of knitted materials, so that it has intensely been greatly desired hitherto to seek a measures for preventing the occurrence of pill on acrylic fibers.

Thus, various methods have hitherto been proposed for preventing the occurrence of pill. The methods proposed can be roughly classified into a method of preventing the occurrence of nap which is the main cause of pilling and a method of letting the nap, even if it occurs, fall off before formation of pill. Generally speaking, the former method is poor in permanency of antipilling property and, in addition, the method is restricted by the structure or textural form of a textile fabric and therefore its extensive application cannot be expected. In order to give textiles a practically advantageous antipilling property, the latter method, i.e. the method of letting nap fall off before it entangles to form a pill, is effective.

As a concrete method for this, there has been attempted adoption of a low stretch ratio in the step of producing fiber or to give a local defects to fibers in order to decrease the strength of the fibers. Although a practically desirable antipilling property may be obtained by these techniques in many cases, these techniques have on the contrary an important fault that the decrease in fiber strength causes a drop in processability or spinnability and particularly causes the occurrence of fly waste, an increase in unevenness of yarn and a decrease in the strength of the spun yarn and thereby lowers the product quality and damages its higher order processability.

The present inventors have conducted extensive studies on acrylic fibers produced by dry-spinning process which are desired by many users as clothing fiber with the aim of obtaining an antipilling fiber excellent in durability and processability. As the result of the studies, this invention was accomplished.

The essential points of this invention consists of the following:

(1) An acrylic synthetic fiber produced by the dry-spinning process fulfilling the following fiber characteristics: a tensile strength (hereinafter, simply referred to as DS) ranging from 1.2 to 2.5 g/denier, a knot strength (g/denier)-knot elongation (%) product (hereinafter, simply referred to as DKS×DKE) of 25 or less, and a boiling water shrinkage rate (hereinafter, simply referred to as BWS) of 5% or less, and (2) A process for producing a fiber characterized by dry-spinning a spinning solution of acrylonitrilic polymer containing 85% by weight of more of acrylonitrile, stretching the spun fiber in hot water at a stretch ratio ranging from 1 to 2, subjecting the stretched fiber to a drying and relaxing to give it a shrinkage of 10–40% and then stretching it at a stretch rate of 1.2–2.3 at a temperature of 180°–210° C.

The fiber of this invention has a sufficient strength and elongation, is free from problems such as occurrence of fly even at the time after processings such as spun process and thus is excellent in processability. Further, it exhibits a lower DKS×DKE value than usual acrylic fibers and therefore is quite excellent in antipilling property.

Usual acrylic fibers obtained by dry-spinning process have a DKS×DKE value of 40–80 and a high boiling water shrinage rate. Among them, there are known some fibers having good antipilling property seemingly. However, after boiling water treatment in an after-processing stage, this good antipilling property deteriorates. On the other hand, in the fibers of this invention, since the DKS×DKE value is 25 or less and the boiling water shrinkage rate is as low as 5% or less, the antipilling property is still good even after boiling water treatment.

As a process for obtaining an antipilling fiber having sufficient strength and elongation and a good processability from the acrylic fiber obtained by dry-spinning process, the technique mentioned in Japanese Patent Application No. 150,173/78 may be referred to.

The content of said technique consists in dry-spinning a spinning solution of acrylonitrilic polymer containing 85% by weight or more of acrylonitrile, washing the resulting unstretched fiber, stretching the washed fiber in hot water either after the washing or simultaneously with the washing at an effective stretch ratio (mentioned below) ranging from 0.35 to 0.8, then subjecting the yarn to a drying, relaxing and heat-treatment in order to give it a shrinkage of 5–40%, further stretching it at a stretch ratio of 1.2–2.3 at a temperature of 160°–200° C. and then subjecting it to a constant length heat-treatment at a temperature higher than the latter stretching temperature; provided that:

Effective stretch ratio = Applied stretch ratio/Maximum stretch ratio just before causing breakage of fiber upon stretch Though this technique is fairly effective as a technique for improving antipilling property, it involves a stretching at an effective stretch ratio of 0.35–0.8 and an additional stretching, so that the stretch ratio becomes considerably high as an over-all process. As the result, DS becomes too high to give a satisfactory antipilling property, breakage of yarn often takes place at the time of re-stretching, and inconveniences such as lowering of dyeability can arise. Further, BWS of fiber often becomes higher and antipilling property after the boiling water treatment becomes lower. That is to say, this technique still have various problems to be overcome. The production process of this invention has an important characteristic feature that DS of the fiber is controlled so as not to exceed 2.5 g/denier by stretching the unstretched fiber after the spinning in hot water at a stretch ratio limited to a very low value of 1-2 and BWS of fiber is controlled so as to become 5% or less by limiting the temperature of the second stretching to 180°–210° C.

Hereunder, this invention will be explained in more detail.

The acrylonitrilic polymer used in this invention must contain at least 85% by weight of acrylonitrile. If the content of acrylonitrile is less than above, the fiber properties necessary for clothing fiber, particularly form-stability, become undesirably low. As copolymerizable monomers, acrylic acid or methacrylic acid esters such as methyl acrylate, methyl methacrylate and the like, as well as vinyl acetate, styrene and acrylamides, can be referred to. The degree of copolymerization of these comonomers is 3–10% by weight in usual cases. Further, in order to improve dyeability, acrylic acid, methacrylic acid, allylsulfonic acid, methallylsulfonic acid, vinylbenzenesulfonic acid and their sulfonates, dimethylaminoethyl acrylate and methacrylate, vinylpyridines and the like can be copolymerized. The degree of copolymerization of these comonomers is 3% by weight or less usually.

Said polymer can be produced by any process such as conventional suspension polymerization, solution polymerization, emulsion polymerization and the like. Degree of polymerization of the polymer is preferably in the range of 0.10–0.20 as expressed by its specific viscosity (measured at 25° C. after dissolving 0.1 g of polymer into 100 ml of dimethylformamide containing 0.1 N of sodium rhodanate).

The spinning solution of polymer is prepared by dissolving said polymer into conventional solvent for acrylonitrilic polymer such as dimethylformamide, dimethylacetamide, dimethyl sulfoxide or the like so that concentration of the polymer comes to 20–40% by weight.

The dry-spinning may be carried out by the known process. Thus, the above-mentioned spinning solution is spouted through an orifice into air or inert gas having a high temperature and the solvent is evaporated to an appropriate extent, whereby an unstretched yarn is obtained. The amount of residual solvent in the unstretched yarn becomes 10–30% based on the weight of polymer.

The unstretched yarn is subjected to the primary stretching in hot water at a stretch ratio ranging from 1 to 2 times. Temperature of the stretching is 80°–100° C. and preferably 95° C. or above. It is an important point of this invention that the stretch ratio should be adjusted to a value falling in the above-mentioned range. There is a tendency that a higher stretch ratio gives higher values of DS and DKS×DKE. If it exceeds 2 times, there cannot be obtained a fiber which fulfills the condition that DS should be 2.5 g/denier or less and DKS×DKE should be 25 or less, and as its result a desirable antipilling property cannot be obtained. On the other hand, a lower stretch ratio gives a better antipilling property. It is natural, however, that if the stretch ratio is less than 1 time an appropriate tension cannot be given to the tow in the less spun processability.

The unstretched yarn is washed with hot water either simultaneously with the above-mentioned stretching treatment or before and after it. Temperature of the hot water is preferably 80°–100° C. After the washing, the amount of residual solvent in the yarn usually comes to 2% or less. The tow which has been stretched and washed is subsequently subjected to a drying and relaxing. Though the method of drying and relaxing is not critical, the present inventors mainly employed a method which comprised treating the tow after stretching and washing with a hot air having a relative humidity of 10–40% and a temperature of 130°–160° C. without tension to carry out drying and relaxation simultaneously.

By the relaxing treatment such as mentioned above, the two usually shrinks to an extent of 10–40%.

The tow which has been subjected to drying and relaxing is secondarily stretched at a temperature ranging from 180° C. to 210° C. at a stretch ratio of 1.2–2.3 times and preferably 1.2–1.8 times. By this, a strength necessary to the after-processings such as spun process is given to the tow, and at the same time the value of DKS×DKE decreases greatly so that antipilling property improves. The stretching is carried out between heated hot rolls, on a hot plate or in a heated steam. If the temperature of stretching is lower than 180° C., BWS of the fiber or spun yarn obtained exceeds 5% and the value of DKS×DKE again increases by the boiling water treatment in the after processing step, so that the intended antipilling property cannot be obtained. On the other hand, if temperature of the stretching exceeds 210° C., the fiber is colored or a fusion takes place between single fibers, so that the value of the product drops.

As the secondary stretch ratio, a value falling in the range of 1.2–2.3 times is employed, as has been mentioned above. If the ratio is lower than 1.2 times, DS of the fiber obtained is smaller than 1.2 g/denier or DKS×DKE of the fiber is greater than 25, and the processabilities such as spun processability and the like deteriorate or the antipilling property becomes worse even if spun processability is good, so that the object of this invention cannot be achieved. On the other hand, if the stretch ratio exceeds 2.3 times, DS exceeds 2.5 g/denier or DKS×DKE exceeds 25, so that the intended antipilling property cannot be obtained in any case.

In the description given above, the process for producing a dry-spun acrylic fiber having a good antipilling property, which is one constructional element of this invention, has been mentioned. The above-mentioned conditions for effective said process are all in close relations with one another, and the object of this invention can be achieved only when all the conditions have been satisfied.

As has been mentioned above, the fiber obtainable by the above-mentioned production process always satisfies simultaneously the conditions that DS should be 1.2–2.5 g/denier, DKS×DKE should be 25 or less and boiling water shrinkage rate should be 5% or less.

In the usual dry-spun acrylic fibers, DKS×DKE exceeds 25 when DS falls in the range of 1.2–2.5 g/denier. Although there may some exceptional cases in which DS and DKS×DKE both fall in the above-mentioned ranges in some of the high-bulk treatment yarns or the like, BWS exceeds 5% in such cases. This means that a dry-spun acrylic fiber having the above-mentioned performances is an epoch-making process. Thus, the said fibers constitute another element for effecting this invention.

The present inventors changed the conditions for the above-mentioned production process in various ways to obtain fibers different in values of DS, DKS×DKE and BWS. Comparison of the antipilling properties of the fibers thus obtained gave the results following. Thus, processabilities such as spun processability are governed mainly by DS, and a good spun processability cannot be obtained when DS is less than 1.2 g/denier. Further, antipilling property is governed mainly by DS and DKS×DKE, and a good antipilling property can be obtained when DS is 2.5 g/denier or less and DKS×DKE is 25 or less.

Further, it was also found that, even in a fiber of which DS is 1.2–2.5 g/denier and DKS×DKE is 25 or less, DS becomes less than 1.2 g/denier or DKS×DKE becomes greater than 25 after the boiling water treatment in the dyeing step or the like when BWS is higher than 5%.

Accordingly, the above-mentioned ranges of DS, DKS×DKE and BWS are in mutually close relationship. A case in which even one of them is out of the specified range cannot be within the scope of this invention.

The subject matter of this invention will be explained with reference to the following examples.

The measurment of antipilling property was carried out according to method A (60 rpm, after 5 hours) using ICI type testing machine specified in JIS 1-1076 (1937), and the results were classified into rank 1 to rank 5 depending on the change of appearance the knitted fabric (hereinafter, referred to as ICI antipilling test).

The term "fiber good in antipilling property" means a fiber ranking 3rd grade or higher in the ICI antipilling test.

The knitted fabric sample used in the test was prepared by subjecting a fiber to staple fiber spinning to obtain No. 48 single yarn and knitting the latter into a knitted fabric of about 180 g/m$^2$ by means of a knitting machine.

EXAMPLE 1

Into a polymerization reactor equipped with a stirrer were continuously fed 93.5 parts of acrylonitrile, 6 parts of methyl acrylate, 0.5 part of sodium methallyl sulfonate, 400 parts of water, 0.55 part of ammonium persulfate, 4.4 parts of sodium hydrogen sulfite and sulfuric acid, and polymerization was carried out at a temperature of 55° C. The amount of sulfuric acid fed was controlled so as to maintain a pH value of 3.0. The resulting polymer was thoroughly washed and then dried. The polymer was dissolved into dimethylformamide at 50° C. with sufficient stirring to obtain a spinning solution having a concentration of 30%. After heating the solution to 130° C., it was spouted through an orifice (hole number 600, hole diameter 0.15 mm) into an inert gas heated to 200° C. to obtain unstretched yarns. The unstretched yarns were subjected to primary stretching in boiling water at a stretch ratio ranging from 1 to 6 times and washed in boiling water, after which the resulting tows were dried and relaxed without tension at a relative humidity of 10–40% at a temperature of 130°–160° C. Some of the tows were subjected to secondary stretching at a stretch ratio of 1.0–2.5 times by means of steam of hot rollers in the temperature range of 100°–230° C.

By varying the combination of the stretch ratio of primary stretching and the temperature and stretch ratio of secondary stretching, the fibers shown in Table 1 of different performances were obtained. The denier of single fibers came to approximately 2 deniers in all cases.

DS, DKS×DKE and BWS of these fibers were measured and at the same time, the fibers were cut into 51 mm and spun to obtain No. 1/48 spun yarns. Spinnability was evaluated based on the amount of waste fiber in the process of carding; provided that products giving a waste fiber amount of 0.3% or less were classified as "good" and those giving a larger amount of waste fiber were classified as "not good".

The spun yarns were further dyed by boiling them at 100° C. for 60 minutes with 2% owf of Cathilon Blue CD RLH (manufactured by Hodogaya Chemical Co., Ltd.) as a dye.

The dyed yarns were knitted into ponti roma knit fabrics, and their antipilling properties were examined by the before-mentioned ICI antipilling test.

The relations between DS, DKS×DKE, BWS, spun processability and ICI antipilling property of the fibers found in a series of tests are summarized in Table 1.

It is apparant from Table 1 that fibers simultaneously satisfying the conditions that DS falls in a range of 1.2–2.5 g/denier, DKS×DKE is 25 or less (g/denier x %) and BWS is 5% or less are good in spun processability and good in antipilling property.

TABLE 1

| No. | DS (g/denier) | DKS × DKE (g/denier × %) | BWS (%) | Spun processability | ICI antipilling test. (grade) | Note |
|---|---|---|---|---|---|---|
| 1 | 2.5 | 60 | 0 | Good | 1 | Comparative Example |
| 2 | 2.3 | 52 | 1 | " | 1 | Comparative Example |
| 3 | 1.5 | 30 | 0 | " | 1 | Comparative Example |
| 4 | 1.2 | 40 | 1 | " | 1 | Comparative Example |
| 5 | 4.2 | 29 | 0 | " | 1 | Comparative Example |
| 6 | 3.0 | 25 | 0 | " | 2 | Comparative Example |
| 7 | 3.0 | 31 | 0 | " | 1 | Comparative Example |
| 8 | 2.4 | 25 | 0 | " | 3 | Example of this invention |
| 9 | 1.7 | 14 | 1 | "4 | Example of | this invention |
| 10 | 1.6 | 18 | 1 | " | 4 | Example of this invention |
| 11 | 1.4 | 21 | 0 | " | 4 | Example of this invention |
| 12 | 1.2 | 25 | 0 | " | 4 | Example of this invention |
| 13 | 1.1 | 40 | 0 | Not good | 3 | Comparative Example |
| 14 | 1.0 | 23 | 0 | Not good | 4 | Comparative Example |

TABLE 1-continued

| No. | DS (g/denier) | DKS × DKE (g/denier × %) | BWS (%) | Spun processability | ICI antipilling test. (grade) | Note |
|---|---|---|---|---|---|---|
| 15 | 0.9 | 43 | 0 | " | 4 | Comparative Example |
| 16 | 2.8 | 10 | 10 | Good | 2 | Comparative Example |
| 17 | 2.3 | 21 | 14 | " | 2 | Comparative Example |
| 18 | 2.0 | 25 | 7 | " | 3 | Comparative Example |
| 19 | 1.8 | 18 | 4 | " | 4 | Example of this invention |
| 20 | 1.6 | 20 | 3 | " | 4 | Example of this invention |

In No. 13, 14 and 15 where DS was less than 1.2 g/denier, spun processability was not good. In No. 1, 5, 6, 7 and 16 where DS was greater than 2.5 g/denier, satisfactory antipilling property was not obtained even though spun processability was good.

In No. 1, 2, 3 and 4 where DKS×DKE was greater than 25 even though DS was in the range of 1.2–2.5 g/denier, antipilling property was not good.

In No. 17 and 18 where boiling water shrinkage rate was greater than 5% even though DS was in the range of 1.2–2.5 g/denier and DKS×DKE was less than 25, a good antipilling property was still unobtainable.

EXAMPLE 2

By the same procedure as in Example 1, unstretched yarns were subjected to primary stretching in hot water as shown in Table 2 and then subjected to drying and relaxing without tension to give them a shrinkage of 10–40%. The tows thus obtained were further subjected to secondary stretching by means of hot rollers at 190° C. at stretch ratios shown in Table 2.

DS, DKS×DKE and BWS of the fibers thus obtained were measured to obtain the results shown in Table 2. In all the fibers, the final denier was in the range of 2–3 denier.

TABLE 2

| No. | Stretch ratio in primary stretching | Stretch ratio in secondary stretching | DS (g/denier) | DKS × DKE (g/denier × %) | BWS (%) | Note |
|---|---|---|---|---|---|---|
| 1 | 1.0 | 1.0 | 0.9 | 30 | −2 | Comparative Example |
| 2 | " | 1.2 | 1.2 | 25 | −1 | Example of this invention |
| 3 | " | 1.5 | 1.4 | 22 | 0 | Example of this invention |
| 4 | " | 1.8 | 1.8 | 24 | 0 | Example of this invention |
| 5 | " | 2.3 | 2.4 | 20 | 1 | Example of this invention |
| 6 | " | 2.5 | 2.8 | 15 | 1 | Comparative Example |
| 7 | 1.5 | 1.0 | 1.1 | 30 | 0 | Comparative Example |
| 8 | " | 1.2 | 1.5 | 23 | 0 | Example of this invention |
| 9 | " | 1.8 | 2.0 | 15 | 0 | Example of this invention |
| 10 | " | 2.3 | 2.4 | 13 | 0 | Example of this invention |
| 11 | " | 2.5 | 2.8 | 12 | 2 | Comparative Example |
| 12 | 2.0 | 1.0 | 1.5 | 40 | 0 | Comparative Example |
| 13 | 2.0 | 1.2 | 1.5 | 22 | 0 | Example of this invention |
| 14 | " | 1.8 | 2.1 | 18 | 0 | Example of this invention |
| 15 | " | 2.3 | 2.5 | 18 | 1 | Example of this invention |
| 16 | " | 2.5 | 3.2 | 15 | 1 | Comparative Example |
| 17 | 2.5 | 1.0 | 1.8 | 30 | 0 | Comparative Example |
| 18 | " | 1.2 | 2.6 | 18 | 0 | Comparative Example |
| 19 | " | 1.5 | 3.0 | 15 | 2 | Comparative Example |

As is apparent from Table 2, in No. 17, 18 and 19 where the stretch ratio in the primary stretching was greater than 2, DS exceeded 2.5 g/denier or DKS×DKE exceeded 25.

Though a stretch ratio smaller than 1 was tentatively employed in the primary stretching in some runs, a sufficient tension could not be given to the tows so that a satisfactory result could not be obtained.

In No. 1, 7, 12 and 17 where stretch ratio in the secondary stretching was smaller than 1.2, DS was smaller than 1.2 g/denier of DKS×DKE was greater than 25.

In No. 6, 11 and 16 where stretch ratio in the secondary stretching was greater than 2.3, DS was always greater than 2.5 g/denier. In No. 16 where stretch ratio of primary stretching and stretch ratio of secondary stretching were both high, breakage of yarn often took place at the time of secondary stretching.

It was understandable from the above-mentioned results that a DS value of 1.2–2.5 g/denier and DKS×KDE value of 25 or less can be realized only when stretch ratio of primary stretching is 1–2 and simultaneously stretch ratio of secondary stretching is 1.2–2.3. BWS were less than 5% in all cases. These fibers were spun and knitted by the same procedure as in Example 1, and antipilling properties of the fabrics thus obtained were evaluated. As the result, spinnability was good in all the cases. Also, ICI antipilling test gave results of 3 grade or higher.

EXAMPLE 3

Tows were stretched by repeating the procedure in No. 9 of Table 2, Example 2, except that only the temperature of secondary stretching was adjusted to the value shown in Table 3 by changing the temperature of hot rollers. It was also attempted to carry out the stretching by blowing steam into a box having a length of about 3 m, for covering the tow, provided between rollers, instead of heating the hot rollers. In this case, the temperature of tow was 95°–105° C.

DS, DKS×DKE and BWS of the fibers thus obtained were measured to obtain the results shown in Table 3.

TABLE 3

| No. | Temperature in secondary stretching (°C.) | DS (g/denier) | DKS × DKE (g/denier × %) | BWS (%) | Note |
|---|---|---|---|---|---|
| 1 | 190 | 2.0 | 15 | 0 | Example of this invention |
| 2 | 180 | 2.0 | 18 | 0 | " |
| 3 | 170 | 2.2 | 15 | 6 | Comparative Example |
| 4 | 150 | 2.4 | 10 | 15 | " |
| 5 | 200 | 2.0 | 15 | 0 | Example of this invention |
| 6 | 210 | 2.0 | 14 | 0 | " |
| 7 | 220 | 1.9 | 14 | 0 | Comparative Example |
| 8 | 230 | 1.7 | 10 | 0 | " |
| 10 | 95–105 (Steam) | 2.5 | 13 | 35 | " |
| 11 | 95–105(1) | 1.5 | 23 | 26 | " |
| 12 | 95–105(2) | 1.2 | 25 | 9 | " |

(1)Stretch ratio of secondary stretching: 1.5
(2)Stretch ratio of secondary stretching: 1.2

As is apparent from Table 3, in runs where the temperature of secondary stretching was lower than 180° C., BWS was greater than 5%. Although in these runs the results of ICI antipilling test was good in the state not subjected to boiling water treatment, antipilling property dropped to 2nd grade or lower after the same dyeing and boiling water treatment as in Example 1. On the other hand, in No. 7 and 8 where the temperature of secondary stretching was higher than 210° C., coloration due to the high temperature and breakage of yarn often took place, so that the process could not be advantageous industrially. When the temperature of secondary stretching was in the range of 180°–210° C., the above-mentioned troubles did not occur in any runs and the result of ICI antipilling test was also good.

Such results were generally obtainable from fibers of which stretch ratio of primary stretching was 1–2.

EXAMPLE 4

A raw spinning solution was prepared by dissolving 70 parts of the same polymer as used in Example 1 and 30 parts of vinyl chloride into 120 parts of dimethylformamide with a sufficient stirring at a temperature of 50° C. The spinning solution was spun by the same procedure as in Example 1, and the unstretched yarn was primarily stretched at a stretch ratio of 1.2 in boiling water and then dried and relaxed. The shrinkage rate of fiber in the process of relaxing was 25–30%. Subsequently, it was tried to secondarily stretch the tow at a stretch ratio of 1.5–1.8 by means of hot rollers having a temperature of 190° C. However, breakage of yarn took place to a great extent, and the study was stopped.

When the same test as above was carried out by using 15 parts of vinyl chloride, the above-mentioned trouble did not took place and the object of this invention could be achieved.

What is claimed is:

1. A process for producing an acrylic fiber having, as its characteristic properties, a tensile strength of 1.2–2.5 g/denier, a knot strength (g/denier)-knot elongation (%) product of 25 or less and a boiling water shrinkage rate of 5% or less which comprises dry-spinning a spinning solution of an acrylonitrilic polymer containing 85% or more of acrylonitrile, stretching the resulting fiber in hot water at a stretch ratio ranging from 1 to 2, then subjecting the fiber to a drying-relaxing treatment to give it a shrinkage of 10–40% and further stretching it at a temperature of 180°–210° C. at a stretch ratio of 1.2–2.3.

2. A process for producing an acrylic fiber as set forth in claim 1, wherein the temperature of the first stretching is 80°–100° C.

3. A process for producing an acrylic fiber according to claim 1, wherein the drying-relaxing treatment is conducted in hot air having a relative humidity of 10–40% and at a temperature of 130°–160° C. without tension.

4. A process for producing an acrylic fiber, which comprises dry-spinning a spinning solution of an acrylonitrile polymer containing 85% or more of acrylonitrile, stretching the resulting fiber in hot water at a stretch ratio ranging from 1 to 2, then subjecting the fiber to a drying-relaxing treatment so that it has a shrinkage of 10–40% and further stretching the fiber at a temperature of 180°–210° C. at a stretch ratio of 1.2–2.3, whereby the resulting fiber has a tensile strength of 1.2–2.5 g/denier, a knot strength (g/denier)-knot elongation (%) product of 25 or less and a boiling water shrinkage rate of 5% or less.

* * * * *